US005664997A

United States Patent [19]

Hess

[11] Patent Number: 5,664,997

[45] Date of Patent: Sep. 9, 1997

[54] APPAREL AND EQUIPMENT LOCKER INCORPORATING CONTAMINATION AND TOXIC MATERIALS EXTRACTION AND EVACUATION SYSTEM

[76] Inventor: William R. Hess, 2297 Walnut Blvd., Walnut Creek, Calif. 94596

[21] Appl. No.: 666,079

[22] Filed: Jun. 19, 1996

[51] Int. Cl.[6] ..... F24F 7/08

[52] U.S. Cl. ..... 454/253; 109/1 V

[58] Field of Search ..... 454/237, 250, 454/257, 253; 109/1 V

[56] References Cited

U.S. PATENT DOCUMENTS

| | | | |
|---|---|---|---|
| 292,444 | 1/1884 | Pilling | 454/237 |
| 1,841,957 | 1/1932 | Kelly | 454/253 |
| 1,842,286 | 1/1932 | Potter . | |
| 1,968,271 | 7/1934 | Thornton, Jr. . | |
| 2,112,347 | 3/1938 | Ross | 454/237 X |
| 2,113,468 | 4/1938 | Ross | 454/237 X |
| 2,216,873 | 10/1940 | Browne . | |
| 2,335,173 | 11/1943 | Corey | 454/252 X |
| 3,133,772 | 5/1964 | Brandes et al. . | |
| 5,076,151 | 12/1991 | Carrier | 454/253 |
| 5,310,254 | 5/1994 | Dallaire . | |

FOREIGN PATENT DOCUMENTS

| | | |
|---|---|---|
| 4-129505 | 4/1992 | Japan . |
| 7-227322 | 8/1995 | Japan . |

*Primary Examiner*—Harold Joyce

[57] ABSTRACT

A locker incorporating a contamination and toxic materials extraction and evacuation system. An enclosure is provided with an access opening and an access door which when open enables the placement of wearing apparel and other contaminated equipment within the interior of the enclosure. When the door is closed, the interior of the enclosure is sealed from the surrounding environment. A duct system connects the interior of the enclosure with the outside atmosphere, admitting fresh air into the enclosure and forcibly drawing contaminated air from the interior of the enclosure and dispersing such contaminated air to the outdoor environment. The duct system embodies non-corrosive materials, and creates a partial vacuum within the interior of the enclosure to effect "out-gassing" of the contaminants and toxins from the protective wearing apparel suspended within the enclosure.

5 Claims, 4 Drawing Sheets

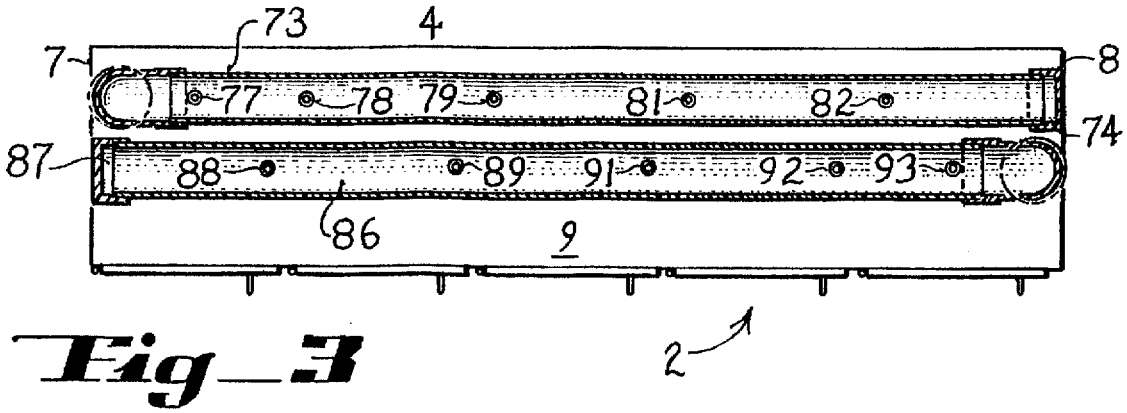
Fig_3
Fig_4
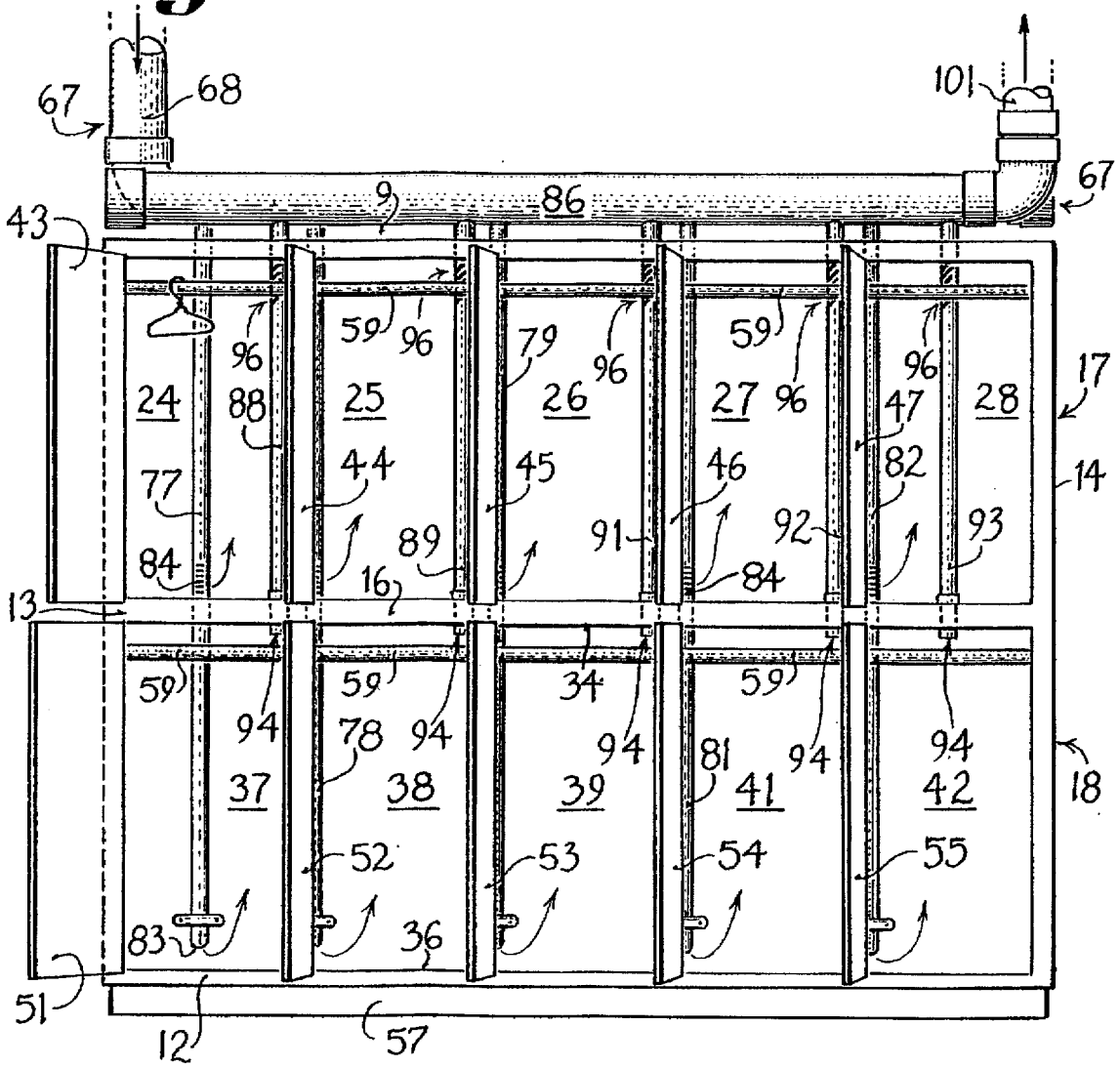

APPAREL AND EQUIPMENT LOCKER INCORPORATING CONTAMINATION AND TOXIC MATERIALS EXTRACTION AND EVACUATION SYSTEM

BACKGROUND OF THE INVENTION

1. Field of the Invention

The invention relates to enclosures for storing contaminated wearing apparel, such as clothing, and contaminated personal equipment utilized in the same environment in which the wearing apparel is contaminated, and particularly to wearing apparel and personal equipment utilized by fire fighters in the course of fighting fires.

2. Description of the Prior Art

A preliminary patentability and novelty search in connection with the instant invention has revealed the existence of the following United States patents:

| | | |
|---|---|---|
| 1,842,286 | 1,968,271 | 2,113,468 |
| 2,216,873 | 3,133,772 | 5,310,254 |

While the patents listed provide a good insight into the condition of the art, none of the patents appear to disclose or even suggest the very real problem faced by fire fighters when they return to the firehouse or station following even a short bout with a stubborn fire of any kind of flammable material. The problems faced by fire fighters are multiplied and made more intense, requiring remedial action more quickly and extensively to decontaminate the fire fighters' bodies, their wearing apparel and the personal equipment used in fighting the fire, when it is known that the burning material has liberated or created toxic contaminants that saturate clothing and stick to personal equipment.

Frequently, to fight such fires, it is expedient, even necessary for the personal safety of the flue fighters, that they wear self-contained breathing apparatus and special protective clothing so as to protect their lungs and bodies from being seared by flames and hot fumes, and contaminated by toxins liberated by or created by the fire. When fire fighters return to the firehouse or station from such a fire, it is very important that they immediately decontaminate their bodies, their wearing apparel, and their personal equipment that might have been contaminated by toxic smoke, fumes and chemicals. Obviously, to decontaminate their bodies, the fire fighters must bathe quickly and thoroughly. To do so they must remove there wearing apparel and personal equipment and step into whatever bathing facilities are provided at the fire station.

One problem is that when contaminated wearing apparel and personal equipment is doffed by the fire fighter, it must immediately be sealed away from the interior environment in which the fire fighters live, including eating and sleeping quarters, lest that interior environment, left clean and uncontaminated when the fire fighters left to fight a fire, is unintentionally contaminated by toxins emanating from the doffed contaminated wearing apparel and personal equipment. It is unfortunate that in many fire stations, no provision is made for either sealing contaminated wearing apparel and personal equipment away from living quarters within the fire station, or taking procedural steps to decontaminate contaminated wearing apparel and equipment.

Accordingly, one of the important objects of the present invention is the provision of a locker within a fire station, the interior of the locker being sealed from the living quarters so that contaminants and toxins on wearing apparel and personal equipment stored therein cannot migrate from the interior of the locker into the living quarters of the fire station.

Another object of the invention is the provision within the living quarters of a fire station of a locker for contaminated wearing apparel and personal equipment that is sealed from the interior of the fire station but is vented to the atmosphere outside the fire station.

Yet another object of the invention is the provision within a fire station or other enclosed environment with which contaminated wearing apparel or personal equipment is doffed, of a storage locker that is sealed from the interior of the fire station or other enclosed environment, and which storage locker incorporates a duct system for forced ventilation of the interior of the sealed locker to the atmosphere exteriorly of the fire station or other enclosed environment so as to preclude the possibility of migration of contaminants from doffed wearing apparel into the uncontaminated interior of the fire station or other environment.

Providing a sealed enclosure, such as the locker above described, and providing forced ventilation of the interior of the locker to the outside atmosphere, will forcibly extract some contaminants and toxic gaases from wearing apparel hung within the locker, but will fail to extract contaminants embedded in the clothing. The reason for this failure is that most such ventilation systems merely circulate outside air through the locker, but do not usually provide a differential in pressure between the air being evacuated from the interior of the locker and the air being admitted and circulated within the interior of the locker. Accordingly, a still further object of the invention is the provision of a locker sealed from the interior environment within which it is located and that incorporates a ventilation system in which the interior volume within the locker is maintained at a pressure less than atmospheric whereby embedded contaminants and toxins are literally "out-gassed" from the wearing apparel into the low pressure interior of the locker and forcibly pumped out of the interior of the locker and dispersed into the a atmosphere exteriorly of the environment sought to be protected against contaminants and toxins.

It is not uncommon a fire stations to hang expensive contaminated protective clothing exteriorly of the fire station where it is subjected to ulta-violet degradation and additional particulate contamination. Accordingly, a still further object of the invention is the provision of a storage locker for protective clothing that simultaneously provides for "out-gassing" from the protective clothing of contaminants and toxins and which protects the clothing from ultra-violet degradation.

Frequently, protective clothing worn by fire fighters becomes wet either from fluids, such as water, or liquidous chemicals utilized to extinguish burning materials, or from perspiration generated by proximity to high heat and physical exertion. Accordingly, yet another object of the invention is the provision of a locker system that may be erected within and sealed from a protected and uncontaminated environment such as the interior of a fire station while providing means for forcibly circulating clean dry air through the interior of the locker to effectively dry moist clothing contained therein.

Still another object of the invention is the provision of a sealed locker structure that is modular in form, that provides separate isolated interior compartments for isolation of wearing apparel contaminated by different types of contamination to thereby prevent cross-contamination of such wearing apparel, and the provision of separate forced air ventilation of each separate compartment to the exterior atmosphere.

The invention possesses other objects and features of advantage, some of which, with the foregoing, will be apparent from the following description and the drawings. It is to be understood that the invention is not limited to the embodiment illustrated and described but may be embodied in various forms within the scope of the appended claims.

SUMMARY OF THE INVENTION

In terms of broad inclusion, the locker incorporating a contamination and toxic materials extraction and evacuation system comprises an enclosure provided with an access opening and an access door adapted when open to enable the placement of wearing apparel and other contaminated equipment within the interior of the enclosure, and which door when closed seals the interior of the enclosure from the surrounding environment. A duct system connects the interior of the enclosure with the outdoor atmosphere, admitting fresh air into the enclosure and forcibly drawing contaminated air from the interior of the enclosure and dispersing such contaminated air to the outdoor environment. Such duct system embodies non-corrosive materials, and creates a partial vacuum within the interior of the enclosure to effect "out-gassing" of the contaminants and toxins from the protective wearing apparel suspended within the enclosure.

BRIEF DESCRIPTION OF THE DRAWINGS

FIG. 3 is a horizontal cross-sectional view taken in the plane indicted by the line 3—3 in FIG. 1.

FIG. 4 is a front elevational view of the locker system shown with the doors open to illustrate the arrangement of the forced air ventilation duct system in relation to the interior of the locker structure.

DESCRIPTION OF THE PREFERRED EMBODIMENT

Figure 1:
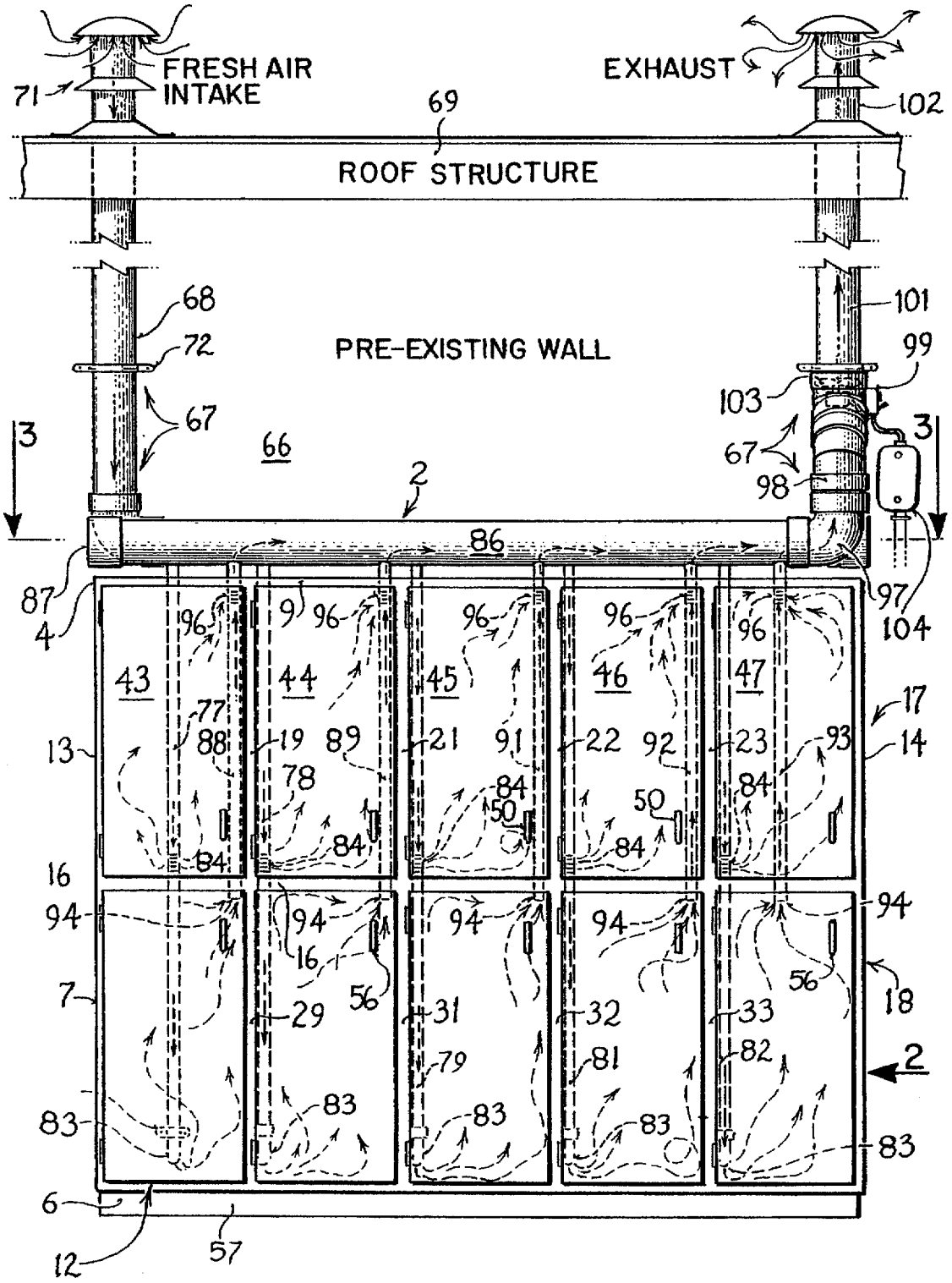
FIG. 1 is a front elevational view of a closed locker system according to the invention shown installed within the interior of a building in association with an existing building wall and roof structure.

In terms of greater detail, the apparel and equipment locker of the invention incorporating contamination and toxic materials extraction and evacuation system means, comprises an air-tight enclosure that is sealed against the entry or egress of air except through a duct system provided for that purpose. Stated in other words, the enclosure is constructed in such a manner that it may be opened to place within its interior contaminated wearing apparel and equipment required to be de-contaminated and which, when the locker door is closed, it is sealed against the entry or egress of air except through an appropriate duct system that communicates the interior of the enclosure with the out-of-doors environment.

Referring to the drawings, the locker is designated generally by the numeral 2, and includes a rear wall 3 fabricated or formed from a suitable material such as wood, plastic or metal to provide an upper edge 4, a bottom edge 6, and left and right side edges 7 and 8. In a prototype structure, the locker was constructed of plywood panels to have an exterior height of approximately 88" and an exterior width of approximately 105". It will of course be understood that these dimensions are merely illustrative and are not to be considered limiations since the height and width of the locker enclosure may be selected to satisfy many different installation parameters that might be encountered in various locations where a locker system such as that described herein is to be installed.

Suitably fastened and sealed in an air-tight manner to corresponding marginal edge portions of the rear wall are an upper wall 9, which may be designated the "roof" or top of the locker, a lower wall 12, which may be designated the "floor" or bottom of the locker, a left side wall 13 and a right side wall 14 opposite and parallel to side wall 13, both intercepting corresponding end edges of the "roof" and "floor" walls 9 and 12, respectively. The wall members are, each secured by one marginal edge portion to the associated marginal edge of the rear wall by screws (not shown) or other appropriate means, and the wall members project perpendicularly from the rear wall to form a box-like structure having an open front defined by the front edges of the wall members which lie in a common vertical plane.

Medianly between the upper and lower walls 9 and 12, respectively, there is provided a horizontal intermediate wall 16 secured and sealed at opposite end edges to the associated inner surfaces of the side walls 13 and 14. The intermediate wall 16 thus transforms the total interior space defined by the wall elements 9, 12 and 13, 14 into an upper chamber 17 and a lower chamber 18, conveniently of approximately equal size and volume.

It should be understood that while the locker 2 has be herein illustrated and described as a single box-like structure divided into two chambers 17 and 18 by the intermediate wall 16, another embodiment (not shown) might comprise two separate box-like structures corresponding in size and volume to each of the upper and lower chambers 17 and 18, with the two box-like structures stacked one above the other to achieve essentially the same configuration. In that case, the "roof" of the lower structure supports the "floor" of the upper structure, and the two structures provide essentially the same interior volume as a single structure, but are modular in form and assembly.

Since the locker is intended for use by a multiplicity of fire fighters, each of whom wears apparel sized to fit, it is important that each fire fighter have ready access at all times to his particular wearing apparel and personal equipment. Accordingly, referring to the drawings, it will be seen that the upper chamber 17 is provided with four laterally spaced vertical partitions 19, 21, 22 and 23, equally spaced between side walls 13 and 14, and fixedly interposed in vertical parallelism between the underside surface of upper wall 9 and the upper surface intermediate wall 16. Each partition is secured by screws or other appropriate securement to the upper wall, the rear wall and the intermediate wall. The union therebetween is sealed air-tight in any suitable manner, such as by one of the various caulking compounds, e.g., silicone sealant or construction adhesive. The vertical partitions, thus convert the interior of the upper chamber 17 into five separate upper compartments 24, 25, 26, 27 and 28.

In like manner, the lower chamber 18 is also provided with equally spaced correspondingly spaced vertically oriented and parallel partitions 29, 31, 32 and 33, each secured at its upper end by screws (not shown), or other suitable securement, to the underside surface 34 of intermediate wall 16, and similarly secured by screws to the upper surface 36 of the lower wall 12 As previously discussed, appropriate sealants or caulking are interposed between the back, upper and lower edges of each partition to seal the union between each partition and contiguous structure. It should be noted that the front edges of the partitions lie in a vertical plane common to the front edges of the upper, lower and side walls as discussed above. Thus, the lower chamber 18 is, like upper chamber 17, divided into five separate lower compartments 37, 38, 39, 41 and 42, each sealed air-tight from the adjacent lower compartments, and also sealed air-tight from the upper compartments 24–29 when the front of the box-like locker structure is sealed closed, as will now be discussed.

To seal each of the compartments, each compartment is provided with a flush overlay door dimensioned to sealingly overlap a front edge portion of an associated side wall portion, the front edge portion of the intermediate wall, and the front edge portion of an associated partition. Thus, referring to FIG. 1, the five upper compartments 24, 25, 26, 27 and 28 are provided, respectively, with doors 43, 44, 45, 46 and 47. Each door is hinged along its left edge as viewed in FIG. 1. Thus, door 43 is provided with a pair of vertically spaced spring-pressed hinges 48 one leaf of each of which is secured to the inner surface of the associated upper portion of left side wall 13. The opposite parallel right edge of the door 43 sealingly overlaps the front edge of the vertical petition 19. The top and bottom edge portions of door 43 overlap the front edge of the upper ("roof") wall 9 and lower ("floor") wall 16 as shown. Obviously, the left edge portion (hinge edge) of the door sealingly overlaps the front edge of side wall 13.

To insure an air-tight seal between the inner surface edge portions of the door 43 and the associated wall portions 9, 13, 16 and 19, a ⅛ thick seal member 49 is attached to the inner surface of the door adjacent its perimeter, or to the wall member defining the opening closed by the door. Thus, when the door is closed, the seal member 49, which is preferably formed from a closed-cell synthetic resinous material such as polyurethane, precludes the unintentional admission of air to the interior of the compartment.

In the interest of brevity in this description, it is noted that each of the doors 43–47, inclusive, are similarly hinged and sealed in relation to the compartments 24–28, respectively, with which each is associated. Each door is provided with a door pull 50 adjacent its edge opposite the hinged edge for convenience in selectively opening or closing each door.

In like manner, referring to FIG. 1, and particularly the lower chamber 18 containing compartments 37–39 and 41–42, each compartment is provided with a door similarly hinged and sealed as described above with respect to doors 43–47. Thus, doors 51–55 are hinged in association with lower compartments 37–39 and 41–42, respectively, by similar hinges 48, and each door is provided with a door pull 56 by which each door may be selectively opened or closed. Where it appears warranted, releasable latches or catches, such as mutually attractive magnetic latches (not shown) may be installed to releasably retain each door in a closed and sealed condition. As will hereafter be explained, other forces are applied to retain the doors in a closed and sealed condition.

The locker thus described is preferably manufactured as a modular unit that may be easily combined with other like units to meet the needs of a particular installation. Alternatively, as previously described, the locker may be constructed as two separate units, one to be stacked upon the other, or in a side-by-side relationship. Additionally, the number of compartments may be varied to more or less than ten to satisfy the needs and cost constraints of a particular installation.

Figure 2:
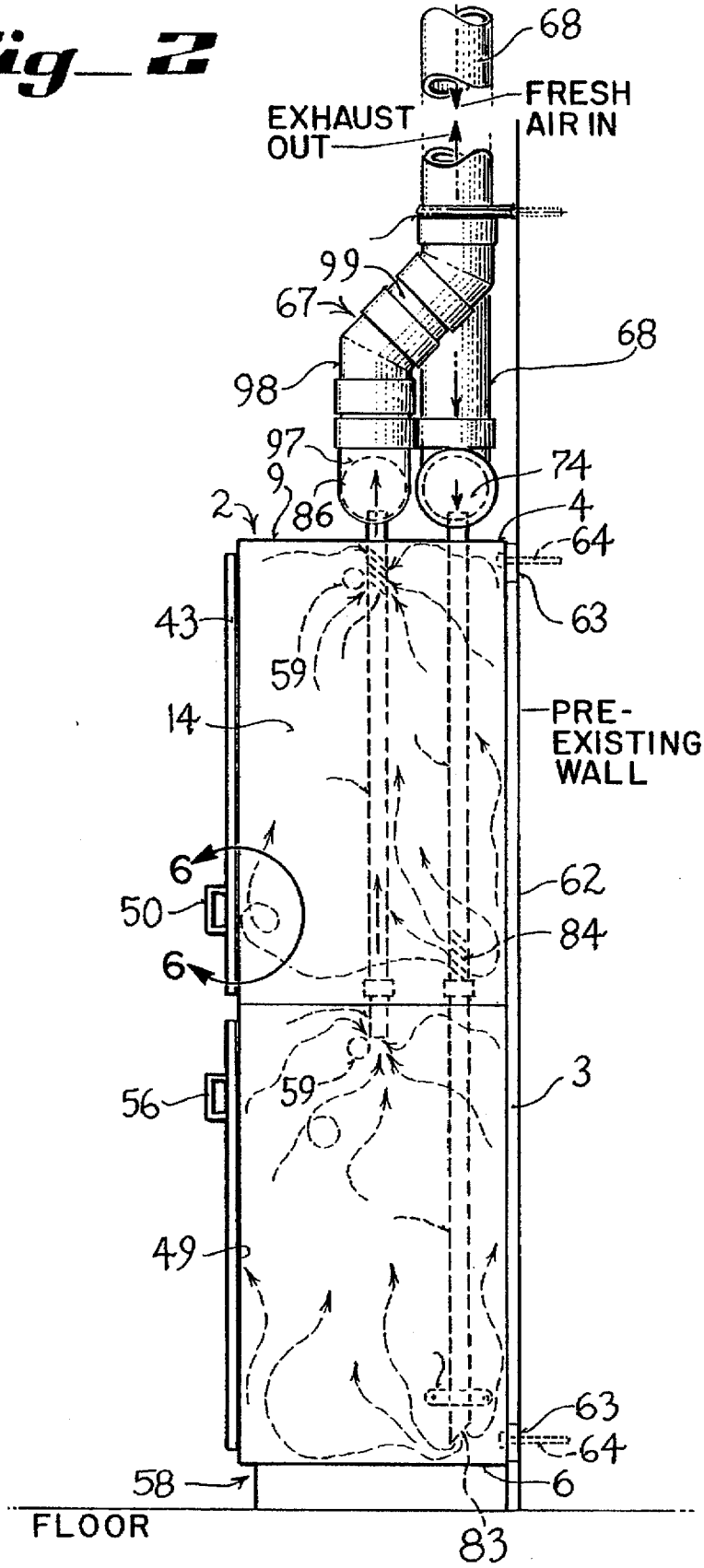
FIG. 2 is an end elevational view taken in the direction indicated by the arrow 2 in FIG. 1.
Figure 5:
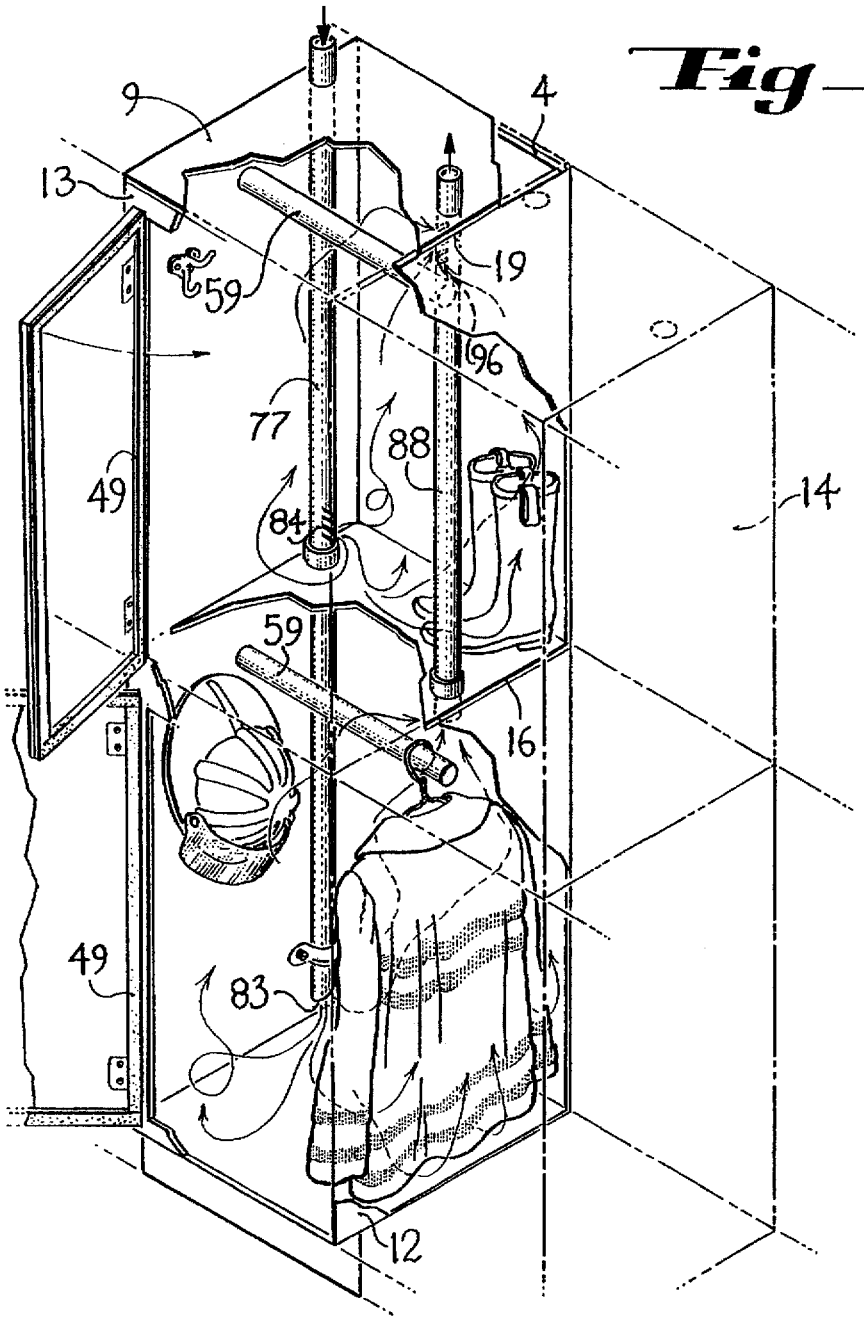
FIG. 5 is an enlarged fragmentary perspective view illustrating the relationship of the air inlet and air outlet openings in the duct system within each compartment of the locker in relation to the rear and side walls of two associated, locker compartments.
Figure 6:
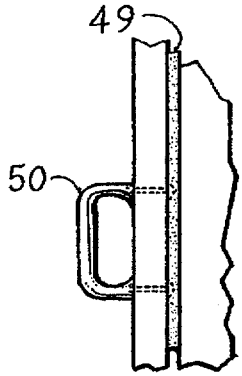
FIG. 6 is an enlarged fragmentary cross-sectional view illustrating the air-tight seal provided between the inner surface of each door and the perimeter of the access opening into each compartment when the door is closed.

Whether manufactured as illustrated and described, or larger, or smaller, or in multiple modular units, the locker system is preferably supported on a base 57 that provides a recessed toe space 58 below the front face of the locker, as shown in FIG. 2. The base may be fabricated from any suitable material, such as wood, or it may constitute a poured concrete slab. To conveniently suspend wearing apparel and personal equipment within each compartment, each compartment is provided with a horizontal closet pole 59, nominally 1½" in diameter, and spaced sufficiently below the upper wall 9 and below the intermediate wall 16 and speed from the rear wall sufficiently to enable suspension of a clothes hanger bearing wearing apparel on the closet pole. Additionally, the side walls of each compartment are provided with heavy duty coat hooks 61 on which heavy outer protective jackets may be suspended, or on which various items of personal equipment may be suspended.

The locker thus constructed and/or assembled from premanufactured modules, may be placed adjacent an existing wall 62 through use of shims 63 adjacent the top and bottom of the locker, and secured to the wall by appropriate fasteners 64, such as nails or screws, that are driven through the rear wall 3, through the shims, and into the wall structural members 66.

After the locker is thus anchored permanently in place, a duct system designated generally by the numeral 67 is applied to direct clean fresh air into each of the compartments and to exhaust contaminated air therefrom. To facilitate extradition of contaminants from the wearing apparel suspended in each locker, clean fresh air is delivered to adjacent the bottom of each locker in sufficient volume and velocity to cause turbulent air currents within each locker, buffeting the wearing apparel to shake loose particulate matter and expose greater areas of the wearing apparel to the turbulent air currents circulating through the locker.

Thus, referring to FIGS. 1 and 2, the air duct system includes a fresh air inlet conduit 68 that extends through the roof 69 to provide an exterior extension 71 as shown through which clean fresh air is admitted into the conduit 68. The conduit 68 is preferably of a diameter to carry a large volume of air, for instance 6" diameter polyvinyl chloride (PVC), Schedule 40. As shown, the conduit is anchored to the building wall 62 by appropriate straps 72. At its lower end adjacent the top or upper wall 9 of the locker, the conduit 68 is connected in an air-tight manner with a horizontally extending air inlet manifold conduit 73 supported on the upper wall 9 of the locker and closed at its end 74.

As shown in FIG. 1, the air inlet manifold conduit 73 extends for the full width of the locker. Sealingly connected perpendicularly into communication with the air inlet manifold conduit 73 at spaced locations corresponding to the spacing of each set of upper and lower compartments 24/37, 25/38, 26/39, 27/41 and 28/42, are air inlet conduits 77, 78, 79, 81 and 82, respectively, each conduit passing downwardly through the upper wall 9 and through intermediate wall 16, to terminate adjacent lower wall 12 in an elliptical opening 83 that faces the rear wall of the locker. Appropriate caulking (not shown) is provided in the upper and intermediate walls where the conduits pass through to preclude the passage of contaminated air from one compartment to another. In each of upper compartments 24–28, the inlet air conduit is provided with angled slots 84 spaced above the intermediate wall 16 that face the rear wall so that air emanating from the slots impinges on the rear wall and turbulently circulates upwardly through wearing apparel suspended within each compartment.

Since contaminated air must be exhausted from the locker, and specifically from each separate compartment, the duct system 67 also included a main exhaust manifold 86, also of Schedule 40 PVC and at least as large or larger in diameter as the air inlet manifold 73. The air exhaust manifold 86 also extends completely across the top of the locker and is supported thereby in parallelism with the air intake manifold 73. The air exhaust manifold is closed at its left end 87, and is sealingly connected in communication with downwardly directed exhaust conduits 88, 89, 91, 92 and 93, each exhaust conduit associated, respectively, with compartments 24/37, 25/38, 26/39, 27/41 and 28/42 as shown in FIG. 1. Each of the exhaust conduits passes through the upper wall 9 and the intermediate wall 16, and each terminates just below the intermediate wall 16 in exhaust openings 94 that evacuate contaminated air from the lower compartments 37–39 and 41–42.

To evacuate contaminated air from the upper compartments 24–28, each of the exhaust conduits is provided with air exhaust slots 96 formed just below the upper wall 9, the slots facing the rear wall of the locker or compartment. To evacuate contaminated air, the exhaust manifold is connected by a suitable 90 degree elbow 97 to a pair of interconnecting 45 degree elbows 98 and 99, the latter connected to an upwardly extending exhaust conduit 101 that passes through the roof, as shown, to provide an air exhaust extension 102 above the roof and communicating with the exterior atmosphere.

To forcibly evacuate contaminated air from the locker, and specifically from each separate compartment, a continuous duty electric motor-driven exhaust fan 103 is provided within the exhaust conduit 101 as shown in FIG. 1. The exhaust fan assembly is connected electrically to a standard 110 Volt outlet 104. Preferably, the exhaust fan assembly exhausts at least 150 cubic feet per minute of air from the locker.

In operation it is preferable that the amount of air being admitted into each of the compartments be gauged so that a slight negative pressure is maintained in each compartment. Maintaining such a negative pressure may be gauged by the dimensions of the inlet and outlet conduits, by the volume of air exhausted as compared with the volume of air admitted and/or by appropriate valving (not shown) or damper (not shown) interposed in the air inlet conduit and adjustable to control the volume of fresh air admitted into the locker. The purpose of maintaining a negative pressure is to facilitate "outgassing" of toxic gases and particulate matter from the wearing apparel suspended in each compartment so that it may be entrained in the body of contaminated air being drawn out of the locker by the exhaust fan.

Having thus described the invention, what is believed to be new and novel and sought to be protected by letters patent of the United States is as follows.

I claim:

1. A locker for extracting and evacuating contaminants and toxins from wearing apparel and personal equipment, comprising:

a) an enclosure having walls defining at least one chamber within which contaminated wearing apparel and personal equipment may be suspended for de-contamination;

b) at least one opening providing access to the interior of said at least one chamber to facilitate suspension therein of wearing apparel and personal equipment;

c) a door mounted on said enclosure in operative association with said at least one opening and selectively movable between open and closed condition, said door when in closed condition sealing said at least one opening against the passage of air therethrough; and d) duct means communicating with said chamber and operable to deliver a moving volume of clean fresh air therethrough so as to entrain toxins and contaminants from the wearing apparel and personal equipment with said moving volume of air and simultaneously evacuate from said locker contamination air.

2. The locker according to claim 1, wherein said enclosure defines a plurality of separate chambers, and said duct means communicates with each said chamber to deliver clean fresh air to each and to evacuate contaminant-laden air from each chamber.

3. The locker according to claim 1, wherein said duct means includes a clean-air inlet manifold disposed adjacent one wall of said enclosure and a contaminated-air exhaust manifold disposed adjacent said clean-air manifold, a clean air conduit sealingly communicating at one end with said clean-air inlet manifold and sealingly extending through one wall of said enclosure and terminating in an open inlet end within said chamber adjacent an opposite wall of said enclosure, and a contaminated-air exhaust conduit sealingly communicating at one end with said contaminated-air exhaust manifold and having at least one contaminated-air outlet adjacent said one wall of said enclosure for evacuating contaminated air from said enclosure, and exhaust fan means operatively connected to said contaminated-air exhaust manifold to evacuate said contaminant-laden air from said chamber.

4. The locker according to claim 1, wherein said locker is placed within a building having a roof, and said duct means includes a main clean-air inlet conduit extending through said roof, a clean-air inlet manifold communicating with said main clean-air inlet conduit that extends through the roof, at least one auxiliary clean-air conduit communicating with said clean-air manifold and said chamber, a contaminated-air exhaust manifold, at least one contaminated-air auxiliary exhaust conduit communicating with said contaminated-air exhaust manifold and extending into said chamber, a contaminated-air main evacuation conduit communicating with said contaminated-air exhaust manifold at one end and extending through said roof at its other end, and a continuous duty electrically driven exhaust fan in said contaminated-air main evacuation conduit operable to evacuate contaminant-laden air from said chamber.

5. The locker according to claim 4, wherein said enclosure defines a plurality of separate chambers, and said duct means communicates with each said chamber to deliver clean fresh air to each and to evacuate contaminant-laden air from each chamber.

* * * * *